US005235789A

United States Patent [19]

Rackowski

[11] Patent Number: 5,235,789

[45] Date of Patent: Aug. 17, 1993

[54] MODULAR PANEL SYSTEM

[76] Inventor: Dennis Rackowski, 17 Slater St., Amsterdam, N.Y. 12010

[21] Appl. No.: 639,878

[22] Filed: Jan. 11, 1991

[51] Int. Cl.[5] ..... E04H 5/00

[52] U.S. Cl. ..... 52/239; 52/238.1

[58] Field of Search ..... 52/238.1, 239, 584, 52/586, 580, 581, 589, 241, 71; 160/135, 351

[56] References Cited

U.S. PATENT DOCUMENTS 4,375,829 3/1983 Dorr et al. .

4,638,614 1/1987 Wilcox ..... 52/238.1

4,956,953 9/1990 Bates ..... 52/239

5,117,599 6/1992 Voss ..... 52/239 X

*Primary Examiner*—Carl D. Friedman

*Assistant Examiner*—Creighton Smith

*Attorney, Agent, or Firm*—Schmeiser, Morelle & Watts

[57] ABSTRACT

An modular panel system in which each panel is connected to an intermediary member by a spring biased connector assembly. The connector assembly includes a pivotable finger member that has an extending portion that can grip an interior sidewall of the intermediary member. The system allows the user to quickly and easily position the panels in any orientation only limited by the shape of the intermediary member.

6 Claims, 4 Drawing Sheets

MODULAR PANEL SYSTEM

FIELD OF THE INVENTION

The invention is in the field of modular panel systems. More particularly, the invention is a portable, multi-panel system in which adjacent panels are fastened to an intermediary member by a manually releasable fastener apparatus

BACKGROUND OF THE INVENTION

Portable panel systems are commonly used in office landscaping and for display purposes at trade shows and exhibits. In offices, they form partitions and interior hallways. As display units, the panels will have either written or pictorial matter affixed to at least the front surfaces of each panel, and sometimes to both the front and rear panel surfaces.

Generally, a plurality of flat rectangular panels are assembled into the desired structure by the use of conventional fasteners or couplings. Between each pair of panels is normally found an intermediary beam member that is used to provide a vertical attachment point for the panels. The beam member may also act as the primary vertical support for the panel unit. Once the panel system has been assembled, the individual panels are often oriented in a coplanar manner. The panels may also be placed at an angle to each other with perpendicular or forty five degree orientations being frequently used.

A typical prior art panel usually consists of a rectangular outer frame that has removable rectangular facings attached to its front and rear sides. The hardware used to connect adjacent panels is normally found along the exterior side or top edges of the outer frame. In the prior art, a variety of different apparatus are taught to accomplish the connection function.

Sak et al (U.S. Pat. No. 3,356,404) shows a modular panel system in which the panel edges have a special shape that is designed to engage a specially shaped support beam.

Nelson (U.S. Pat. No. 4,821,788) teaches a locking system for display panels. The system makes use of a telescoping support beam that has tabs adapted to engage elongated retainer channels that are located along the side edges of each connected panel.

Dorr et al (U.S. Pat. No. 4,375,829) teaches a display panel system that includes hollow intermediary support columns and panel mounted retainers. The retainers function by locking onto the top and bottom ends of the support column. Each retainer includes a pivotable "L"-shaped finger member that can be manually moved to engage or disengage the associated panel member from the support column.

There are a number of problems associated with prior art panel systems. The panels are difficult to erect since they often require the assembler to make adjustments at the extreme top and bottom edges of the panels. This can be a significant problem when working with panels that are seven feet in length or that have bottom edges that directly contact the floor.

Another problem with prior art panel systems is that they are difficult to erect when it is desired to place one panel at an angle to an adjacent panel. Most of the prior art patents previously noted involve different methods to solve this longstanding problem. However, none of the prior solutions to the angling problem are simple in nature or are easy to fabricate. To achieve a forty-five degree angle between panels often requires complicated connecting hardware that can only be assembled using special tools.

It is therefore a principal object of the invention to provide a modular panel system that is easily portable and that can be quickly assembled or disassembled without tools.

It is a further object of the invention to provide a modular panel system that does not require the assembler to reach the extreme top and bottom edges of each panel during the panel connection process.

Another object of the invention is to provide a panel system in which the panels can be mated to a number of differently shaped intermediary support members.

Another object of the invention is to provide a panel system in which the connecting hardware rigidly and securely attaches each panel to its associated joining or intermediary member.

A further object of the invention is to provide a panel system in which adjacent panels can be easily placed at any desired angle to each other.

SUMMARY OF THE INVENTION

The invention is a modular panel system that allows the user to interconnect panels quickly and easily without tools. In the preferred embodiment, an intermediary or joining member acts to stabilize and vertically fix the panels.

Each panel is preferably formed from an outer frame onto which front and rear facings are removably attached. A spring-biased connection mechanism is located proximate each corner of the frame to enable the panel to be rigidly secured to an adjacent hollow member. The mechanism includes an "L" shaped finger that is pivotally connected at one end to the exterior of the frame. The finger extends outwardly from the frame and its outer end functions to engage an interior wall of the intermediary or joining member.

A spring-loaded pin is connected to the movable finger to allow manual positioning of the finger and also to releasably lock the finger's position. The pin extends into the interior of the frame and has an outer end that slidably attaches to the movable finger. The inner end of the pin is located within the area surrounded by the frame and is easily accessible. A spring is located about the body of the pin and is captured between the inner end of the pin and the interior surface of the frame.

The sides of the panel (outer frame) are preferably made by an extrusion process. The exterior side of the extrusion has a "U"-shaped channel designed to inwardly receive the intermediary member. Located at the base of the "U" is an outwardly extending "V"-shaped portion. The "V"-shaped portion enables the panel to connect to an intermediary member in a number of different ways. For example, if a square channel is used as the intermediary member, a corner of the square channel can be snugly received within the "V"-shaped portion. Alternatively, a flat side of the square channel can abut the outer ends of the "V"-shaped portion with the two corners adjacent the channel's flat side being received within the "U"-shaped outer perimeter of the extrusion.

To accomplish the multi-position panel to intermediary member connection noted above, a plurality of spaced mounting points are provided for the pivotable, "L"-shaped connecting finger. The spring-loaded pin includes a circular top portion through which the body of the finger member may be moved.

To erect panels at a forty-five degree angle to each other, one can use for the intermediary member either a rectangular hollow beam member or an oversized hollow square beam member. The first panel is connected to the beam in a position where the panel's "V"-shaped portion contacts a flat side of the beam member. The adjacent panel is then connected to the beam member in a position where a corner of the beam member is snugly received within the panel's "V"-shaped portion. This would automatically result in there being a forty-five degree angle between the two panels. It should also be noted that specially shaped hollow beam members can also be used to achieve a forty-five degree angle between adjacent panels.

A ninety degree angling of the panels can be simply accomplished by connecting adjacent panels to adjacent flat sides of a square or rectangular hollow beam member.

By using selectively shaped intermediary beam members, it is possible to arrange the panels in any desired angular orientation. By using a round channel as an intermediary member, panels can be placed at any angle about the exterior of the round channel. Additional fixing members must be added to prevent the panel from inadvertantly moving about the round channel.

DETAILED DESCRIPTION OF THE DRAWINGS

Figure 1:
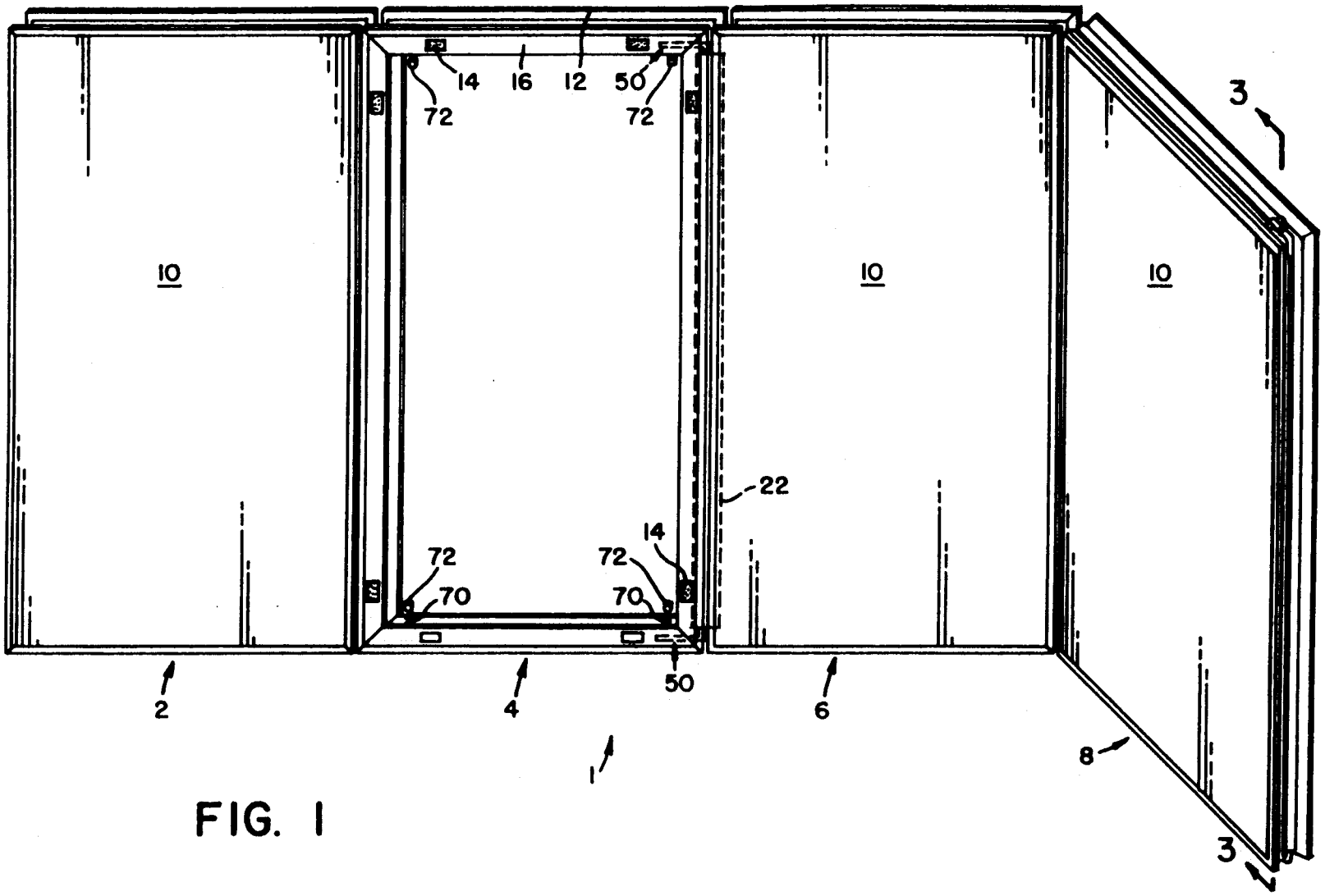
FIG. 1 provides an isometric view of an assembled multi-panel unit in accordance with the invention.

Referring now to the drawings in greater detail, wherein like reference characters refer to like parts throughout the several figures, there is shown by the numeral 1 a multi-panel display unit. The unit is made up of four connected panels 2, 4, 6 and 8. Panels 2, 6 and 8 have a rectangular surface covering or facing 10 removably mounted to the panel's rectangular boundary frame 12. The surface coverings are attached to the frame by Velcro-type hook and pile fasteners or by similar types of conventional fasteners. Panel 4 does not include a surface covering thereby allowing the rectangular boundary frame 12 and portions of velcro strips 14 to be clearly seen. The velcro strips are shown on the front edge 16 of the frame. The strips may also be located on the back edge of the frame if a rear surface covering is used.

The frontal exterior appearance of the panel system is similar to that of coventional panel type display units. However, in FIG. 2, a plan view of the display unit of FIG. 1 is provided. In this latter view one can see that there are a number of differences between a panel unit in accordance with the invention and a prior art panel unit.

Figure 2:
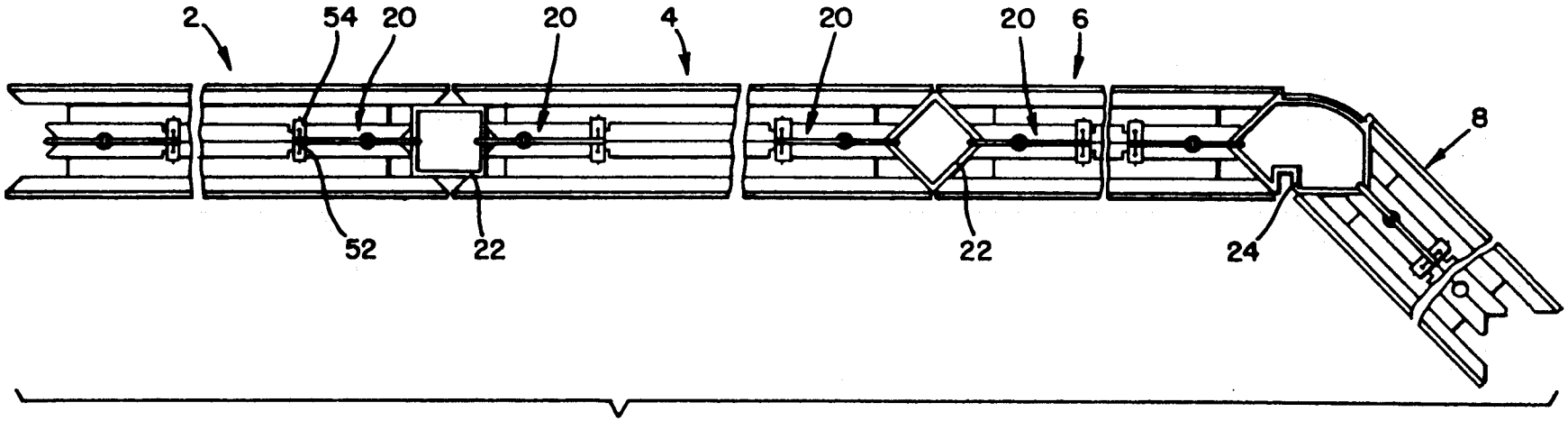
FIG. 2 is a plan view of the multi-panel unit shown in FIG. 1.

Located proximate most corners of the panels is a connection apparatus 20. The apparatus removably locks each pair of panels to a hollow intermediary support or joiner member. Any number of shaped intermediary members may be used with FIG. 2 showing the use of two square tubes 22 and a specially shaped member 24.

Figure 3:
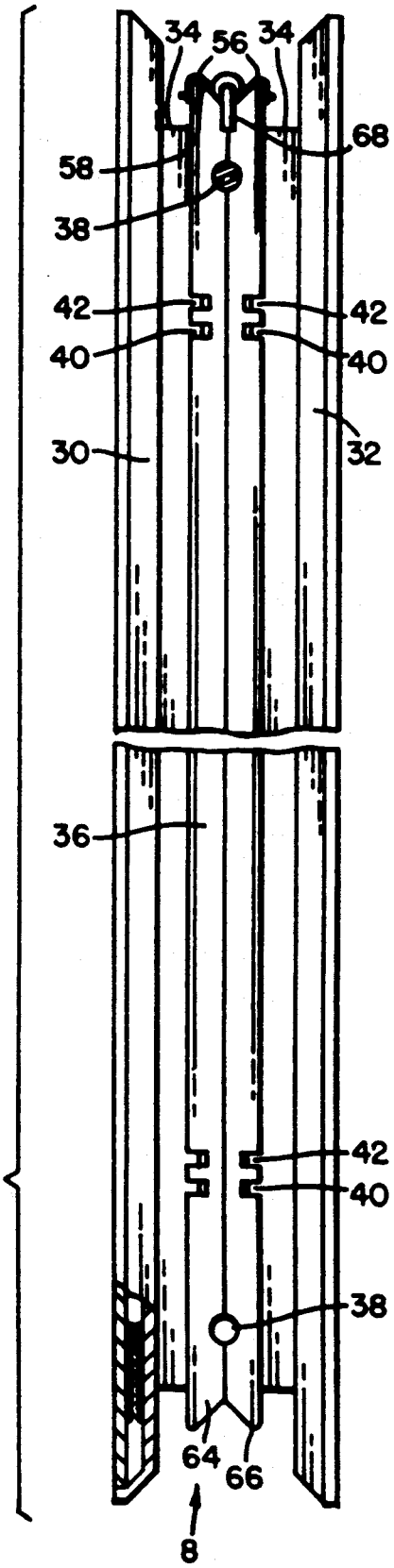
FIG. 3 is a side view of a panel formed in accordance with the invention.

FIG. 3 provides an end view of a side edge of panel 8. In this view and in the view of FIG. 2, the unique shape of the extrusion is readily apparent. The extrusion is preferably fabricated from aluminum but can be manufactured from any rigid material and made in any size or color.

The extrusion comprises a "U"-shaped exterior portion having a left wall member 30, a right wall member 32 and flat connector web 34. Located in the center of the web at the base of the "U" is an outwardly extending "V"-shaped channel 36. Located in the channel 36 proximate each corner of the frame is a through-hole 38 and a pair of notches, 40 and 42. At the top of FIG. 3, an end view of the connector apparatus can be seen.

Figure 4:
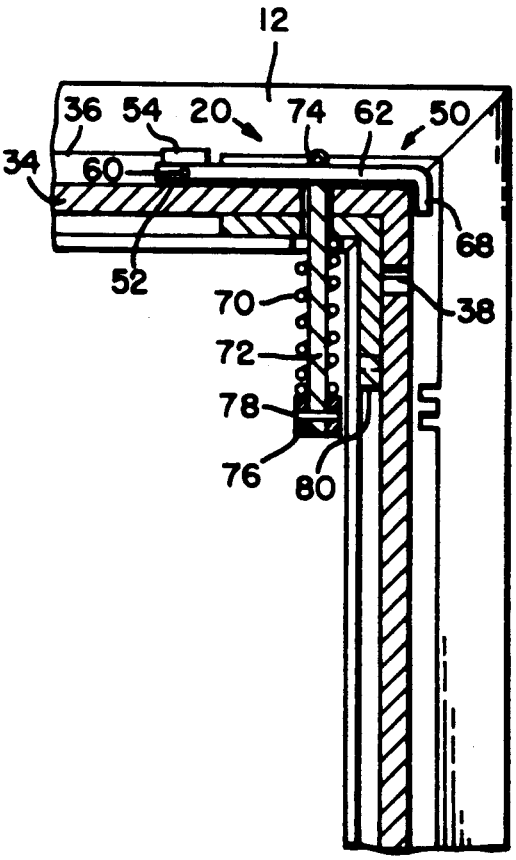
FIG. 4 is a cross-sectional elevation view of an upper corner of a panel that employs a connector in accordance with the invention.

FIG. 4 is a cross-sectional elevation view of a panel corner. In this view can be seen details of the connector apparatus 20.

The connector apparatus 20 consists of an "L"-shaped member 50 that is pivotally connected to the "V"-shaped channel 36 by a pivot pin 52 and spring clip 54. The clip 54 has a shape similar to an "M" where the outside legs 56 straddle the exterior side walls of the channel 36. The legs 56 are inwardly biased in order to help maintain the clip in place. The center portion 58 of the clip has a similar "V"-shape to that of channel 36 and therefore rests snugly atop the upper interior walls of the "V"-shaped channel.

The pivot pin 52 passes through a rear hole 60 in the "L"-shaped member 50. The pin also passes through aligned holes in the clip and is locked onto the clip's outer legs 56. It should be noted that when the clip is in place, the pivot pin passes through one set of channel notches 42 or 44.

The "L"-shaped member 50 is positioned so that its elongated body portion 62 rests in the cleft between the outwardly extending arms 64 and 66 of the channel 36. The member's head portion 68 is oriented perpendicular to the body portion and is positioned so that it extends along the "V"-shaped channel of the adjacent side edge of the panel. This can be seen at the top of FIG. 3.

The "L"-shaped member is spring biased toward the interior of the panel by a spring 70 mounted about an eyebolt 72 in which the interior end of the eyebolt acts as a manual actuator for the connector apparatus. The eye 74 of the eyebolt encircles a portion of the "L"-shaped member in a secure yet slidable manner. (i.e. —the "L" member can be moved longitudinally through the circular opening in the eye of the eyebolt). A nut 76 and washer 78 maintain the spring on the eyebolt. The spring itself is captured between the washer 78 and a bottom surface of an angle member 80. The angle member is fastened by screws or similar fasteners to a bottom surface of the extrusion web 34. It should be noted that if one desires to maintain a panel in an erected state for an extended time, one merely has to lock the eyebolt 72 in position with clamps or similar fasteners.

To erect a multi-panel unit, one first connects adjoining panels to an intermediary member. For example, to connect panel 4 to panel 6, the following procedure would be followed.

The bottom edge of panel 4 is first placed adjacent a bottom edge of intermediary member 22. Next, downward pressure is exerted on the lower right corner eyebolt 72 (shown in FIG. 1) that is adjacent the intermediary member 22. The intermediary member is then partially placed within the "U"-shaped outer perimeter of the side portion of the frame until it contacts the panel's "V"-shaped channel 36. The eyebolt is released and the head portion 68 of member 50 pivots upwardly into the interior of the bottom end of the intermediary member where it contacts and engages the internal wall of the intermediary member. This locks the bottom end of the intermediary member to the bottom portion of channel 36.

Next, the assembler pushes upwardly on the eyebolt 72 located at the top right corner of the panel adjacent the top end of the intermediary member. The top of the intermediary member is then pushed into the top of the side portion of the frame until it contacts the top of the "V"-shaped channel. Once in position, the assembler releases the eyebolt. This causes the member 50 to pivot downwardly and its head portion 68 to enter the top open end of the intermediary member and engage the member's inner wall. This effectively locks the top end of the intermediary member to the top of the panel.

To connect panel 6 to the same intermediary member, the panel's outer facing 10 is removed and the above described basic procedure is again followed. In this manner, two adjacent panels can be quickly and easily connected to a shared intermediary member.

As shown in FIG. 2, the member 50 can be placed in at least two different positions (where its head portion is spaced from the crotch of the "V" or where its head portion approximately contacts the crotch of the "V"). This is accomplished by moving the pivot pin and clip from one set of notches (40 or 42) to the other. This allows the panels to either be connected to a flat side of an intermediary member (For example, the connection shown between panels 2 and 4) or to the corners of an intermediary member (For example, the connection shown between panels 4 and 6). In this manner, numerous different angular panel orientations can be made.

Figure 5:
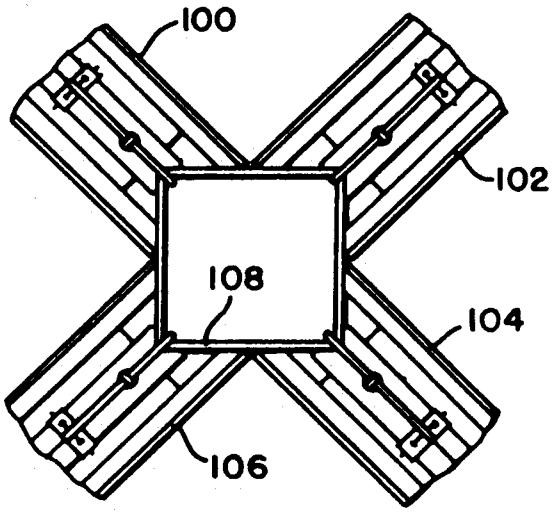
FIG. 5 is a plan view of another panel display unit made in accordance with the invention.

FIG. 5 provides a plan view showing how four panels 100, 102, 104 and 106 can be attached to the corners of a single square intermediary member 102.

Figure 6:
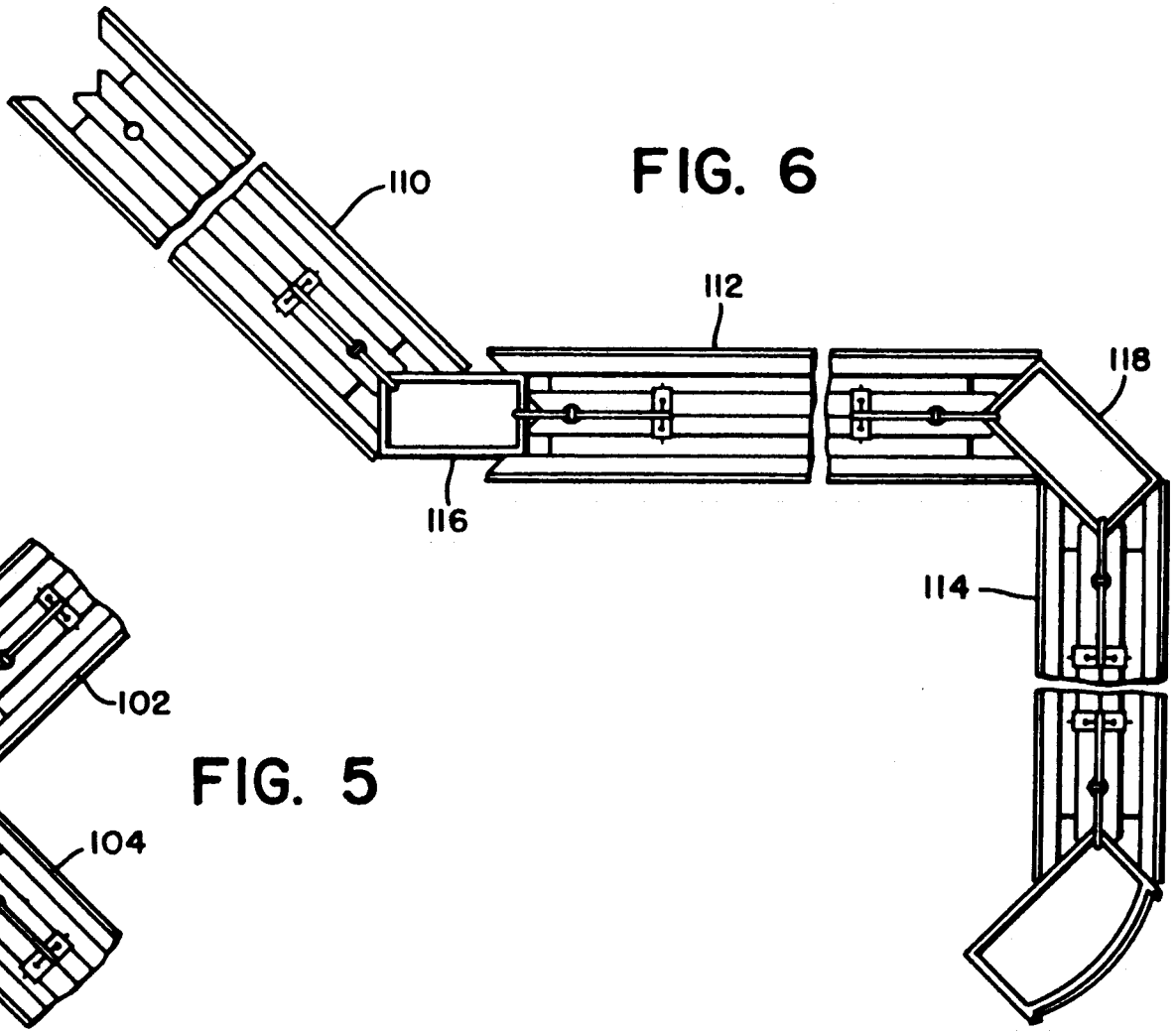
FIG. 6 is a plan view of yet another panel display unit made in accordance with the invention.

FIG. 6 shows a plan view of three connected panels 110, 112 and 114. In this view, the connector apparatus is used to position panels at a forty five degree angle (panel 110 to panel 112) by connecting one panel to a flat side of a rectangular intermediary member 116 and another panel to one of the member's corners.

In FIG. 6, one can also see how two panels (112 and 114) can be connected in a perpendicular manner using an elongated rectangular intermediary member 118.

As already noted, the intermediary member can be of any shape that fits within the outer arms 30 and 32 of the channel shaped panel perimeter and has an internal surface that can be engaged by finger member 50. This would include not only tubes but also angle beams or even the end portions of adapted walls. It should additionally be noted that the intermediary member can be fashioned from two hinged portions (as taught in the Dorr et al patent) in order to allow two connected panels to be pivoted. The hollow interior of the intermediary member can be used for invisibly running wiring to different points of the unit. The intermediary member also serves as an anchor point for the panel. The intermediary member is sometimes referred to as a joiner member since it functions to join the panel to either another panel or to some other point of support.

For most intended uses, a panel will connect to a vertically extending intermediary/joiner member. However, there are times when it is desired to connect a panel to a horizontally extending intermediary/joiner member. To accomplish this, one can merely rotate the panel 90 degrees and attach it to the intermediary member using the same connecting hardware as was used to connect it to a vertical intermediary member. As an alternative, any connector assembly 20 can be quickly removed from the "V"-shaped channel by first removing the pin 52 and clip 54 from the "V" shaped channel. Next, one slides the finger member 50 from the eyebolt 72. The connector assembly can then be reattached to the channel in a position on an adjacent side of a corner portion of the frame (i.e. - if the connector is located along an exterior top portion of a panel corner, it can be moved to an adjacent side portion of the same corner). In this manner, the panel can be attached to a horizontal intermediary member without changing the orientation of the panel.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A modular panel system comprising:

at least one panel having an outer perimeter that includes a top portion, a bottom portion and a side portion wherein an exterior surface of said perimeter is in the form of a "U"-shaped channel;

a spring biased connection means located at least partially on an exterior surface of said top portion of said outer perimeter;

an elongated joiner member having an outer shape that can at least partially be received within said side portion of said panel perimeter and which is adapted to internally receive a portion of said panel connection means; and wherein said "U"-shaped channel includes on a base portion thereof a centrally located "V" -shaped portion made from two outwardly extending ribs that diverge as they extend away from the base portion of the channel.

2. The panel system of claim 1 wherein said connection means includes a finger member that has a shape enabling it to engage an interior surface of said elongated joiner member.

3. The panel system of claim 2 wherein said connection means is adjustable so that said finger means can be moved horizontally along said top portion of said panel perimeter to thereby adapt to different shapes of joiner members.

4. The panel system of claim 3 wherein said joiner member has at least one flat vertical side and one vertically extending right angle shaped corner and wherein one panel is attached to said flat vertical side and another panel is attached to said vertically extending corner thereby causing said panels to be oriented at an angle of approximately forty-five degrees to each other.

5. The panel system of claim 3 further comprising a manual actuator for said connection means located below said top portion of said panel perimeter.

6. A modular panel system comprising:

at least one panel having an outer perimeter that includes a top portion, a bottom portion and a side portion wherein an exterior surface of said perimeter is in the form of a "U"-shaped channel;

a spring biased connection means located at least partially on an exterior surface of said side portion of said outer perimeter;

an elongated joiner member having an outer shape that can at least partially be received within one of said top or bottom portions of said panel perimeter and which is adapted to internally receive a portion of said panel connection means; and wherein said "U"-shaped channel includes on a base portion thereof a centrally located "V" -shaped portion made from two outwardly extending ribs that diverge as they extend away from the base portion of the channel.

* * * * *